US005174360A

United States Patent [19]

Barbe

[11] Patent Number: 5,174,360

[45] Date of Patent: Dec. 29, 1992

[54] PROCESS AND ASSEMBLY FOR FEEDING MOLTEN METAL TO THE INGOT MOLD OF AN INSTALLATION FOR THE CONTINUOUS CASTING OF THIN COGS

[75] Inventor: Jacques Barbe, Saint-Etienne, France

[73] Assignee: Institut De Recherches De La Siderurgie Francaise, Puteaux, France

[21] Appl. No.: 440,555

[22] Filed: Nov. 22, 1989

[30] Foreign Application Priority Data

Nov. 23, 1988 [FR] France ..... 88 15285

[51] Int. Cl.[5] ..... B22D 11/00; B22D 41/58; B22D 41/50; B22D 37/00

[52] U.S. Cl. ..... 164/453; 164/475; 164/449; 164/437; 164/415; 222/590; 222/603

[58] Field of Search ..... 164/475, 488, 489, 453, 164/449, 450, 437, 438, 439, 415; 222/590, 594, 603

[56] References Cited

U.S. PATENT DOCUMENTS

| | | | |
|---|---|---|---|
| 3,502,134 | 3/1970 | Orehoski | 164/475 |
| 3,521,698 | 7/1970 | Colombo | 164/136 |
| 3,578,062 | 5/1971 | Soeda | 164/488 |
| 4,527,718 | 7/1985 | Kingston | 164/437 |
| 4,640,447 | 2/1987 | Geller et al. | 222/603 |
| 4,730,660 | 3/1988 | Tinnes et al. | 164/453 |
| 4,770,230 | 9/1988 | Tinnes et al. | 164/449 |

FOREIGN PATENT DOCUMENTS

| | | | |
|---|---|---|---|
| 0171589 | 2/1986 | European Pat. Off. . | |
| 1951349 | 4/1970 | Fed. Rep. of Germany . | |
| 1509266 | 1/1968 | France . | |
| 58-064308 | 4/1983 | Japan | 164/475 |
| 85015423 | 4/1985 | Japan | 164/423 |
| 1083262 | 9/1967 | United Kingdom . | |
| 1157818 | 7/1969 | United Kingdom . | |

*Primary Examiner*—Richard K. Seidel
*Assistant Examiner*—Rex E. Pelto
*Attorney, Agent, or Firm*—Pollock, Vande Sande & Priddy

[57] ABSTRACT

A process and apparatus for feeding molten metal to the ingot mold (2) of an installation for the continuous casting of thin cogs (3). At least one jet (6) coming from a nozzle (8) connected to a distributor (4) feeds an ingot mold (2) in which the level of metal is regulated. The distributor (4) is movable vertically in order to keep the height of the jet (6) constant and horizontally in the direction of the largest dimension of the ingot mold in order to subject the jet (6) to an alternating lateral movement. The nozzle (8) and the casting tube (10) are protected by a liquefied neutral gas circulating between the tube (10) and a sleeve (25) surrounding the tube (10).

7 Claims, 5 Drawing Sheets

PROCESS AND ASSEMBLY FOR FEEDING MOLTEN METAL TO THE INGOT MOLD OF AN INSTALLATION FOR THE CONTINUOUS CASTING OF THIN COGS

FIELD OF THE INVENTION

The present invention relates to the field of metal working, and more particularly to the continuous casting of molten metals, in particular steel, with a view to producing thin cogs.

More precisely, the present invention relates to a process for feeding molten metal to the ingot mold of an installation for the continuous casting of thin cogs, according to which the ingot mold is fed with molten metal, via at least one vertical runner, flowing from the orifice of a nozzle connected to a distributor of molten metal via a casting tube, and the level of molten metal in the ingot mold is adjusted by acting on the flow rate of metal entering the casting tube.

Prior Art

Such a procedure for feeding an ingot mold is known, for example, from British Patent No. 1,083,262.

Installations for feeding molten metal to an ingot mold for the continuous casting of thin cogs are also known.

In most cases, the installations retain the basic designs of continuous slab-casting machines: ingot mold, oscillation of the ingot mold, device for supporting and cooling the cog or slab emerging from the ingot mold by means of rollers.

Molten metal is generally fed to the ingot mold via one or more calibrated nozzles connected to a distributor for molten metal which, during the casting of the latter, occupies a fixed position above the ingot mold. The top of the ingot mold is flared in order to be able to receive the casting nozzle. The level of the free surface of the metal in the ingot mold is detected by an apparatus which controls a device for adjusting the flow rate and, therefore, for a specific rate of extraction of the product, the level of metal in the ingot mold, the outlet of said device acting on means for adjusting the inlet cross-section of the nozzle in order to modify said entrance cross-section and, consequently, the loss of charge and therefore the flow rate from the nozzle.

During operation, the mouth of the nozzles is in a fixed position inside the ingot mold and may be either submerged in the molten metal or may emerge above the free surface of the molten metal contained in the ingot mold in order to form a vertical jet. The fixed-position mounting of the nozzles is know, for example, from British Patents Nos. 1,083,262 and 1,157,818 and French Patent No. 1,509,266.

It is also known to protect the free surface of the molten metal and the jet coming from a non-submerged nozzle using a liquefied gas which is non-oxidizing with respect to the cast metal, in order to prevent the oxidation of the cast metal and the formation of inclusions. French Patent No. 2,403,849 describes an embodiment of protection of this type.

These know procedures and installations for the continuous casting of thin cogs present a plurality of drawbacks. In the case of casting with a non-submerged nozzle, the jet of metal delivered by the calibrated orifice of the latter tends all the more to lose its cohesion and, therefore, tends to diverge from the theoretical path defined by a cylinder having a cross-section very close to that of the calibrated orifice which has formed said jet, the greater the height of the latter, which adversely affects the metallurgical homogeneity of the cog, particularly when it is thin.

Moreover, in this type of casting, it is known that the metal does not totally fill the casting tube and, because of reduced pressure, produces a pump effect which sucks in the ambient air and, therefore, oxygen because of the porosity of the refractory tube, thus causing oxidation of the molten metal.

Consequently, in current continuous casting installations, the most frequent arrangement of the nozzle is of the "submerged nozzle" type, which avoids having to protect the jet coming from the nozzle as indicated above. In this case, it is known that, even in the casting of large-section products, the metal tends to solidify at the level of its free surface in the ingot mold, thus risking the creation of awkward solidification bridges between the submerged end of the nozzle and the walls of the ingot mold.

Moreover, the life span of the nozzle is thus limited by the erosion it suffers at the meniscus.

In the case of the continuous casting of thin slabs or cogs, the thickness of the casting chamber of the ingot mold being very small relative to its transverse dimension, i.e., its width, the walls of the ingot mold are very close to the nozzle or nozzles and the risk of formation of solidification bridges is that much greater. On the other hand, and as a function of the form of the orifices of the nozzle, preferential circulation currents of the molten metal are created and, for certain arrangements, there is a risk of the formation of a concentration of inclusions in certain zones and, particularly, beneath the casting tube.

SUMMARY OF THE INVENTION

An object of the present invention is to remedy such drawbacks and to improve the metallurgical quality of the thin cogs obtained using continuous casting.

This object is achieved according to the invention in that, in the process mentioned above, the lower end of the nozzle is kept at a constant predetermined distance above the free surface of the molten metal contained in the ingot mold by means of vertical displacement of the distributor as a function of the variations in the level of the molten metal contained in the ingot mold relative to a fixed reference level, while at the same time keeping said lower end of the nozzle inside the ingot mold, and the jet is caused to undergo a horizontal sweeping movement along to the large walls of the ingot mold via a corresponding displacement of the nozzle and of the tube and of the distributor which are integrally attached thereto.

By virtue of this arrangement, the free height of the jet emerging from the nozzle remains constant and as small as possible, regardless of the level of the molten metal in the ingot mold, such that the mixing effect produced by the jet of molten metal in the metal of the cog during solidification is always homogeneous.

The different portions of the large dimension walls of the ingot mold located near the free surface of the metal in the ingot mold and said surface are successively swept by the jet. This also contributes to homogeneous mixing of the molten metal in the upper part of the cog during solidification, prevents solidification irregularities and, above all in combination with the fact that the end of the nozzle is non-submerged, prevents the formation of solidification bridges.

The molten metal which enters into the distributor must be of good quality and should not be altered.

To this end and according to a particular feature of the invention, the casting tube, the nozzle and the jet are surrounded by a layer of liquefied gas, which is non-oxidizing with respect to the cast metal, which flows along said casting tube and along said nozzle, and the free surface of the molten metal contained in the ingot mold is covered therewith over a height at least equal to the distance separating the lower end of said nozzle and said free metal surface.

It is possible to provide, around the casting tube and the nozzle, using a suitable sleeve fixed to the distributor, an annular chamber communicating with a source of liquefied gas and emerging above the free surface of the molten metal contained in the ingot mold via an annular orifice, and said liquefied gas is caused to circulate in said annular chamber, said liquefied gas flowing via said annular orifice above said free metal surface.

The liquefied neutral gas thus protects the jet and the metal in the ingot mold against any oxidation from the oxygen in the air. Moreover, the leak-tightness of the casting tube is supplemented by the sleeve and the liquefied gas contained in the annular space. The thermal insulation formed by the gas and the sleeve contributes to keeping the casting tube at as high a temperature as possible, which hinders the deposition of oxides, such as alumina, which, in known devices, causes blockage of the tube. A substance having high reflectivity as regards the radiation emitted by the metal may be incorporated into the liquefied gas. The tube and the nozzle are then thermally insulated in order not to alter the temperature of the molten metal passing through them.

The liquefied gas in the annular chamber may advantageously be held at a pressure close to the mean ferrostatic pressure existing in the casting tube, at least partially eliminating the radial stresses in the tube due to the ferrostatic pressure, and thereby improving the life span of the tube and of the nozzle.

The present invention also relates to an assembly for feeding a narrow ingot mold of the type comprising a distributor for molten metal disposed above the ingot mold and equipped with a casting tube, at the lower end of which is fixed a nozzle, and with a plunger disposed above the orifice of the casting tube and intended to adjust the flow rate of metal in the casting tube, and comprising a device for measuring and regulating the level of the molten metal in the ingot mold, coupled with said plunger, the lower end of said nozzle penetrating inside the ingot mold and being held at the level of the free surface of the molten metal contained in the ingot mold, which assembly is provided particularly for implementing the procedure of the invention and which comprises means permitting vertical displacement of the distributor as a function of the level of metal in the ingot mold and means for lateral displacement of the distributor in a horizontal sweeping movement along to the large walls of the ingot mold.

BRIEF DESCRIPTION OF THE DRAWINGS

Other advantages and characteristics of the invention will emerge on reading the description which follows, given with reference to the appended drawings, in which.

DESCRIPTION OF THE PREFERRED EMBODIMENT

Figure 1:
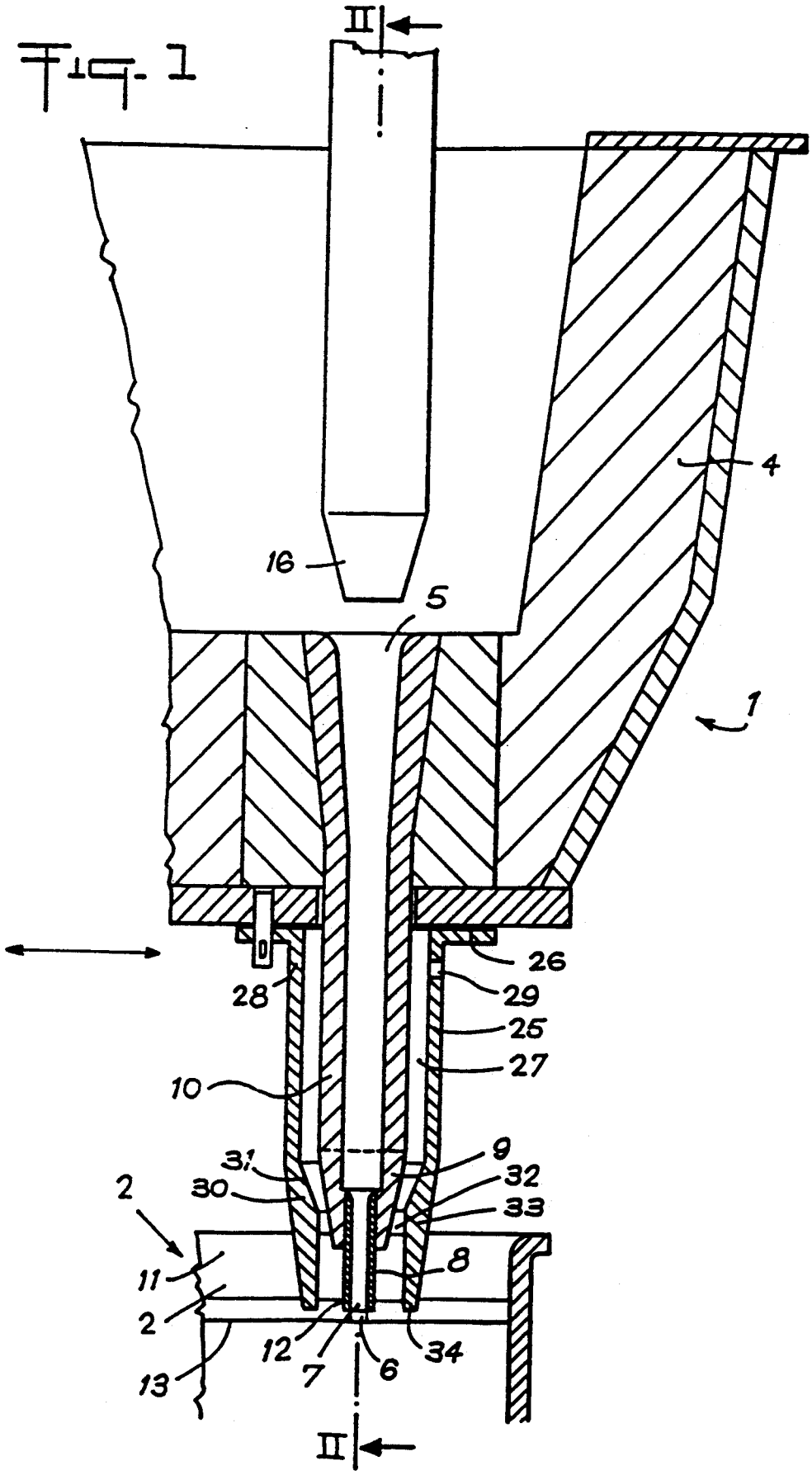
FIG. 1 represents a longitudinal section of the top part of an installation for the continuous casting of thin cogs for implementing the procedure according to the invention, along line I—I of FIG. 2.
Figure 2:
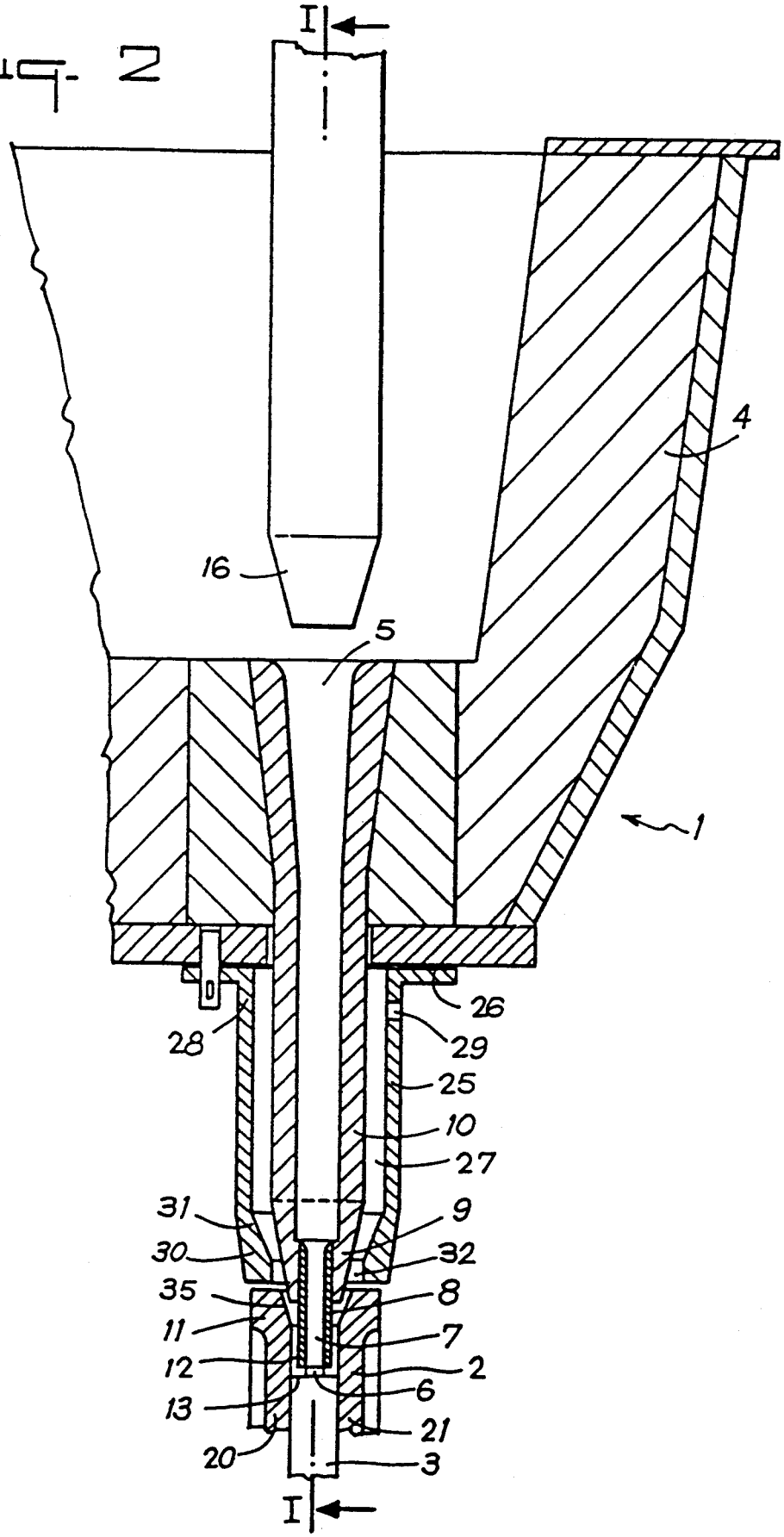
FIG. 2 is a transverse section of the same installation, along line II—II of FIG. 1.

As shown in FIG. 1, installation 1 is provided for feeding a narrow ingot mold 2 intended for the production of thin cogs 3. The feed installation comprises a distributor 4 or tundish containing a bath of molten steel and having an orifice 5 through its base. The distributor 4 continuously feeds, via a vertical jet 6, the ingot mold 2 at the base of which the partially solidified thin cog 3 is withdrawn also continuously. The ingot mold 2 may be subjected to vertical oscillations. The vertical jet 6 emerges from the orifice 7 of a nozzle 8 fixed at the lower end 9 of a casting tube 10 opening out at the orifice 5 through the base of the distributor 4. The upper part 11 of the ingot mold 2 is flared so that the lower end 12 of the nozzle 8 is located in the ingot mold 2 and above the free surface 13 of the molten metal in the ingot mold.

Figure 3:
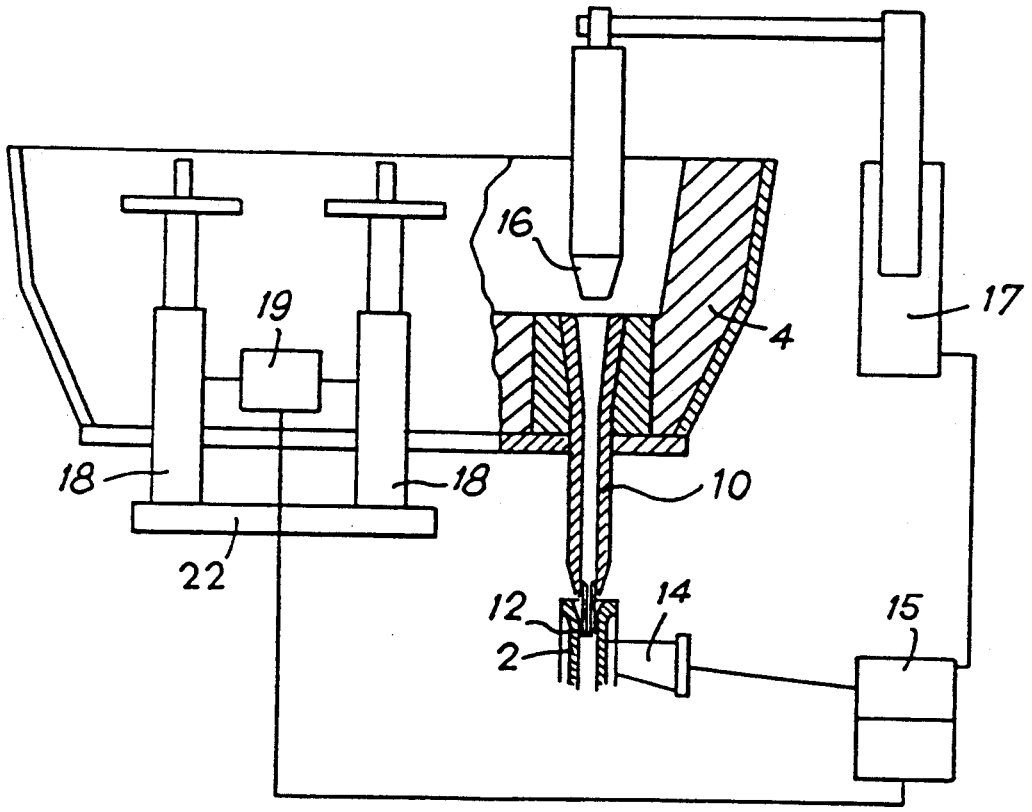
FIG. 3 is a basic diagram showing the devices for regulating the height of the distributor as a function of the level of the metal in the ingot mold.
Figure 4:
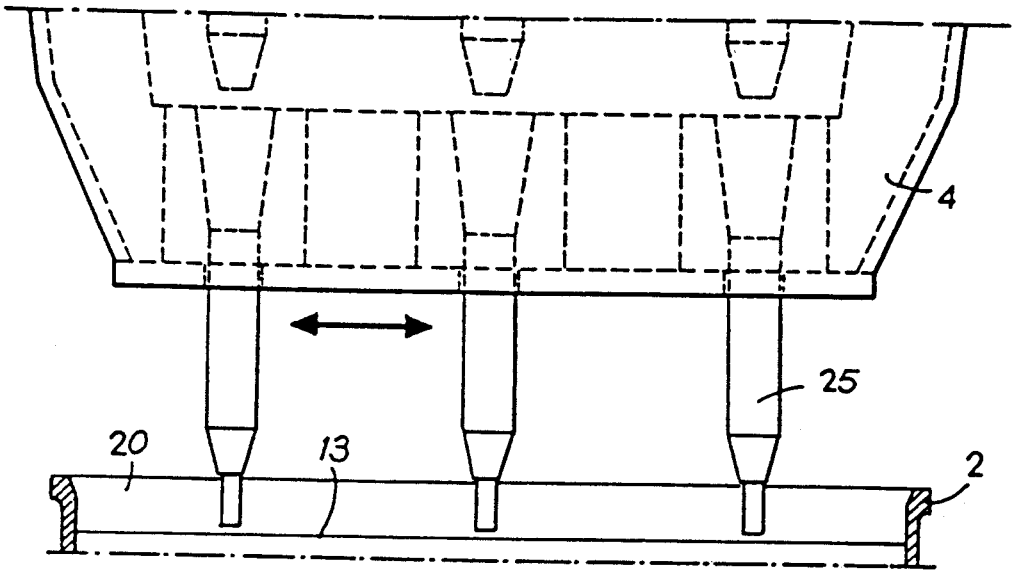
FIG. 4 shows the distributor in its middle position during its lateral displacement.
Figure 5:
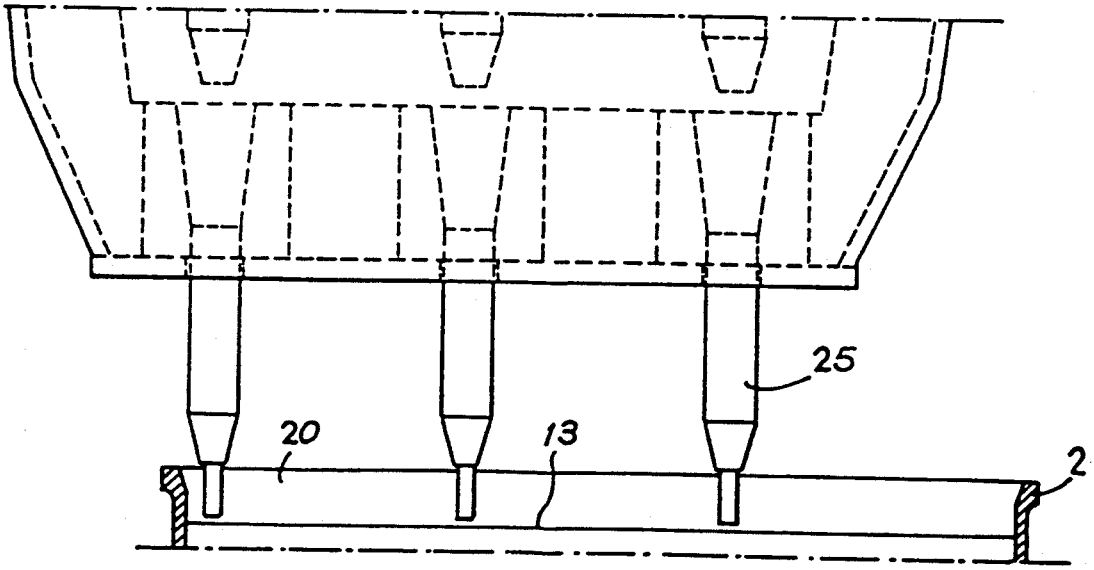
FIG. 5 shows the distributor in one of the extreme positions of its lateral displacement.

As shown in FIG. 3, an apparatus 14 for measuring the height of the free surface 13 of the metal in the ingot mold supplies indications to a device 15 for regulating the level in the ingot mold which acts on the plunger 16 by means of a jack 17. The plunger 16 more or less blocks the orifice 5, thus creating a loss of charge which modifies the ferrostatic pressure in the nozzle 8 and thereby the flow rate in the jet 6.

More precisely, the flow rate of steel is determined by the cross-section of the nozzle and the ferrostatic height, i.e., the height of molten metal above said nozzle. The plunger, or any other suitable blocking device, is used above all at the start and at the end of the casting. Here, the plunger makes it possible, moreover, to modulate the flow rate from the nozzle, in nevertheless a small proportion, creating a loss of charge which is added, relative to the ferrostatic pressure, to the loss of charge created by the nozzle.

The distributor 4 is carried by an assembly of jacks 18, and the height of the distributor 4 is adjusted by a device 19 for adjusting the height acting on the jacks 18 and coupled continuously to the device 15 for regulating the level in the ingot mold, in such a manner that the height of the jet 6, i.e., the distance separating the orifice 7 of the nozzle 8 from the free surface 13 of the metal in the ingot mold, is constant, regardless of the level of the molten metal in the ingot mold 2.

The number of jets 6 is a function of the largest dimension of the ingot mold 2. By way of example, a cog of 1600 mm by 50 mm requires three jets supplied by nozzles 8 which are aligned and uniformly spaced between the walls 20, 21 of largest dimensions of the ingot mold 2.

The distributor 4 is mounted so as to move horizontally in a to-and-fro movement in a direction parallel to the large walls 20 and 21 of the ingot mold 2. To this end, the jacks 18 carrying the distributor 4 are fixed on a support 22 which is displaced through the action of a control member (not shown) in a to-and-fro movement in the direction of the largest dimension of the ingot mold 2, in a manner such that the nozzles 8 located near the lateral ends of the ingot mold 2 alternately move towards and away from the corresponding ends of the ingot mold 2. The duration of a lateral displacement of the distributor 4 is approximately equal to a quarter of the time taken by the cog 3 to pass through the ingot mold 2.

By way of example, for casting a cog 1600 mm×50 mm with a flow rate of 2.8 m/min in an ingot mold having an active height of 1 m and which gives a skin thickness of 12 mm at the exit, the displacement path of the distributor 4 is 510 mm and the displacement takes 5.36 s, which gives a travelling speed of 5.7 m/min, which, from a mechanical viewpoint is very slow.

Figure 6:
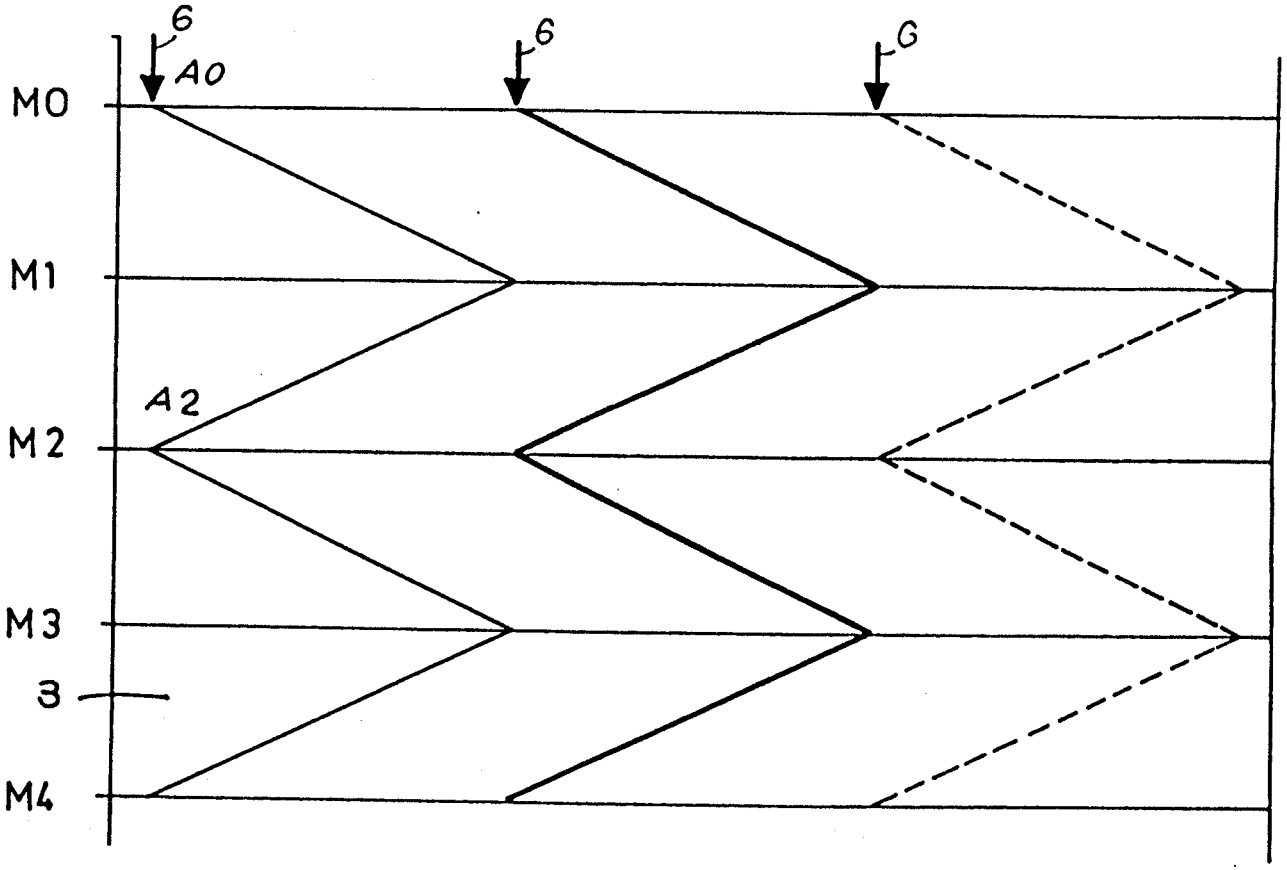
FIG. 6 is a diagram showing the points of impact of the jets on the part of the thin cog located in the ingot mold after two to-and-fro movements of the distributor.

FIG. 6 gives an example of the sweeping of the point of impact A of a jet 6 represented by an arrow through the cog 3 as a function of the advance of the cog which is proportional to time. The meniscus MO defines a section of the cog 3 which progresses in the ingot mold 2, and which is in position M2 at mid-height of the ingot mold when the jet 6 has completed a lateral displacement, to-and-fro, in the ingot mold. At the point A2, i.e., at 50 cm from the point Ao, the solidification of the skin has progressed in thickness by 9 mm and a liquid core of the order of 32 mm remains between the two large faces of the cog 3. The lateral displacement of the jets 6 modifies the currents of molten metal according to the lateral position of the jets 6, thus causing mixing of the liquid core of the cog 3 and preventing irregularities in solidification of the skin.

The casting tube 10 is made of a single piece in a refractory material, and the inner channel of the tube, flared at the top, is continuous between its two ends, and the inner channel of the nozzle 8 is also flared at its top, such that, during operation, the casting tube 10 and the nozzle 8 are filled with molten metal under ferrostatic pressure. The flow rate from the nozzle 8 is a function of the cross-section of the orifice 7 and of the ferrostatic pressure. By way of indication, with a nozzle having a diameter of 19 mm and a length of 140 mm, fixed to a casting tube having a diameter of 50 mm and a length of 650 mm, the flow rate of steel is 600 kg per minute.

It is important that air not penetrate into the nozzle since air has detrimental effects on the metal quality of the cog and on the production of oxides in the nozzle which tend to reduce the cross-section of the orifice 7, and, to a certain extent, it cools the tube.

In order to prevent these drawbacks which are already significantly diminished due to the form given to the casting tube 10 and to the nozzle 8, the casting tube 10 is surrounded by a sleeve 25 of generally cylindrical form which is fixed in a leaktight manner on the lower face 26 of the vessel of the distributor 4. The inside diameter of the sleeve 25 is greater than the outside diameter of the casting tube 10 so as to form an annular chamber 27 between the sleeve 25 and the casting tube 10. The sleeve 25 has, in its upper part 28, an orifice 29 communicating with a source of liquefied neutral gas (not shown).

The lower end 9 of the tube 10 has a tapered or frusto-conical form, and the lower end 30 of the sleeve 25 has an inner wall 31 having a conical form adapted to the outer wall of the lower end 9 of the casting tube, such that the annular chamber 27 emerges near the lower point of the tube 10 via an annular opening 32 located around the nozzle 8.

At the lower end 30 of the sleeve 25 are formed two extensions 33 which are diametrically opposed relative to the nozzle 8. The extensions 33 extend vertically at a short distance from the nozzle 8 and are located between the large dimension walls 20 and 21 of the ingot mold 2, and their lower points 34 are located at approximately the same level as the level of the orifice 7 of the nozzle 8.

Thus the annular opening 32 in the annular chamber 27 emerges above the free surface 13 of the metal in the ingot mold and above the wall portions 35 of the ingot mold located in the vicinity of the nozzle 8.

A liquefied neutral gas, for example liquid nitrogen at −196° C., is circulated in the annular chamber 27, preferably under pressure so as to balance the ferrostatic pressure inside the casting tube 10. The liquefied gas fills the chamber 27 and flows via the annular opening 32 either over the wall portions 35 of the ingot mold or directly along the two extensions 33 of the sleeve 25 in order to finally cover the free surface 13 of the metal in the ingot mold over a thickness such that the jet 6 is entirely immersed in the layer of liquefied gas.

The molten metal in the ingot mold and the jet 6 are thus completely protected from oxygen in the air. Moreover, the nozzle 8 and the lower part of the casting tube 10 are completely surrounded by a layer of liquefied gas which provides thermal protection for the metal contained in the tube 10 and in the nozzle 8 and ensures additional leak-tightness for the assembly.

The invention may be applied to all types of installations for the continuous casting of thin cogs comprising a narrow ingot mold, whether the walls of the latter are fixed or whether they are subjected to vertical oscillations, or alternatively whether they accompany the product during its extraction. Included in this latter category are, in particular, installations known as "twin roll casting machines", which the ingot mold is delimited by the cooled outer surfaces of two parallel cylinders rotating in opposite directions and by end plates laterally blocking off the casting space. In this type of installation, a charge contributed at the casting speed may be reflected in a substantial raising or lowering of the level of the metal in the ingot mold: it is thus particularly advantageous to keep the distance between the feed nozzle and the surface of the metal constant by means of the installation which has just been described.

I claim:

1. Process for feeding molten metal to an ingot mold of an installation for continuous casting of thin cogs comprising two cooled large walls opposite one another, in contact with which walls said metal solidifies, and two end faces defining, with said large walls a casting space, said process comprising the steps of (a) feeding said ingot mold with molten metal via at least one jet flowing from an orifice of a nozzle connected to a distributor of molten metal via a casting tube;

(b) regulating the level of a free surface of said molten metal in said ingot mold by acting on a flow rate of metal in said casting tube;

(c) retaining a lower end (12) of said nozzle (8) inside said ingot mold (2) and at a substantially constant predetermined distance above said free surface (13) of said molten metal contained in said ingot mold by means of vertical displacement of said distributor (4) as a function of variations in the level of said free surface (13) relative to a fixed reference level; and (d) causing said jet (6) to undergo a horizontal sweeping movement along said large walls of said ingot mold via corresponding displacement of said nozzle and said tube and of said distributor which are integrally attached thereto;

(e) said casting tube (10) and said nozzle (8) being surrounded by a layer of liquefied gas, said gas being non-oxidizing with respect to the cast metal and flowing along said casting tube (10) and along said nozzle (8), said free surface (13) of said molten metal contained in said ingot mold being covered with said gas over a height at least equal to a distance separating a lower end of said nozzle and said free metal surface (13).

2. Process claimed in claim 1, wherein, around said casting tube (10) and said nozzle (8), using a sleeve (25) fixed to said distributor (4), is provided an annular chamber (27) communicating with a source of liquefied gas and emerging above said free surface (13) of said molten metal contained in said ingot mold (2) via an annular orifice (32), and wherein said liquefied gas is caused to circulate in said annular chamber (27), said liquefied gas flowing via said annular orifice (32) above said fee metal surface (13).

3. Process claimed in claims 1 or 2; including laterally displacing said distributor (4) in one direction during a period of time equal to approximately one-quarter of time taken by said cog (3) to pass through said ingot mold (2).

4. An assembly for feeding molten metal to a narrow ingot mold (2) comprising two cooled large walls (20, 21) opposite one another, in contact with which walls said metal solidifies, and two end faces defining, with said large walls, a casting space, said assembly comprising a distributor (4) for molten metal disposed above said ingot mold and equipped with a casting tube (10) having a tapered lower end (9), a nozzle (8) affixed at said lower end of said casting tube, and a plunger (16) disposed above an orifice (5) of said casting tube and adapted to adjust a flow rate of metal in said casting tube, and comprising a device (15) for measuring and regulating a level of said molten metal in said ingot mold, coupled with said plunger, a lower end of said nozzle being disposed inside said ingot mold above a free surface (13) of said molten metal contained in said ingot mold, said assembly further comprising means for (19) vertically displacing said distributor, and means for displacing said distributor (4) in a horizontal continuous sweeping movement along said large walls (20, 21) of said ingot mold, said casting tube (10) being surrounded by a sleeve (25) fixed in a leaktight manner to said distributor (4) and positioned to leave an annular space (27) between said casting tube (10) and said sleeve (25), said annular space having a lower annular opening (32), and wherein an inner wall (31) of a lower end (30) of said sleeve (25) is concentric with the form of a lower end (9) of said casting tube (10), and wherein said annular space (27) is connected to a source of liquefied gas.

5. Assembly as claimed in claim 4, wherein said means for vertical displacement of said distributor (4) comprise jacks (18) supporting said distributor (4) whose vertical position is adjusted by a device for regulating the height (19) coupled continuously with said device (15) for measuring and regulating said level (13) of said molten metal contained in said ingot mold (2).

6. Assembly as claimed in claim 5, wherein said jacks (18) are fixed on a support (22) which is movable horizontally and parallel to said large walls (20, 21) of said ingot mold (2).

7. Assembly as claimed in claim 4, wherein said lower end (30) of said sleeve (25) has two extensions (33) which extend downwards and penetrate into said ingot mold in the vicinity of said wall portions of said nozzle (8) which are distant from said large walls (20, 21) of said ingot mold (2), and wherein lower ends (34) of said extensions (33) are located at said lower end (12) of said nozzle.

* * * * *